United States Patent [19]

Masse

[11] Patent Number: 4,682,819

[45] **Date of Patent: * Jul. 28, 1987**

[54] METHOD AND APPARATUS FOR DRILLING HARD MATERIAL

[76] Inventor: Roger Masse, 131, rue Roussin, Thetford Mines, Quebec, Canada, G6G 1N6

[ * ] Notice: The portion of the term of this patent subsequent to Oct. 18, 2000 has been disclaimed.

[21] Appl. No.: 588,741

[22] Filed: Mar. 12, 1984

[51] Int. Cl.[4] ..... E21C 25/00; E21C 41/00

[52] U.S. Cl. ..... 299/10; 299/69; 299/76

[58] Field of Search ..... 175/108, 162; 299/10, 299/53, 62, 69, 70, 73, 75, 76; 173/50

[56] References Cited

U.S. PATENT DOCUMENTS

| | | | |
|---|---|---|---|
| 1,032,049 | 7/1912 | Ebbley | 299/10 |
| 1,059,188 | 4/1913 | McKinnon | 173/50 |
| 1,357,510 | 11/1920 | Pedulla | 173/50 |
| 2,792,205 | 5/1957 | Hagenbook . | |
| 3,090,983 | 5/1963 | Modrak et al. | 299/70 |
| 3,314,722 | 4/1967 | Webster | 299/75 |
| 3,887,236 | 6/1975 | Patrick | 299/10 |
| 3,981,540 | 9/1976 | Hawkes | 299/62 |
| 4,025,116 | 5/1977 | Roepke et al. | 299/76 |
| 4,410,053 | 10/1983 | Masse | 175/53 |

FOREIGN PATENT DOCUMENTS

| | | | |
|---|---|---|---|
| 387281 | 12/1923 | Fed. Rep. of Germany | 299/62 |
| 2147762 | 3/1973 | Fed. Rep. of Germany | 299/70 |
| 2432877 | 12/1975 | Fed. Rep. of Germany . | |
| 533298 | 2/1922 | France . | |
| 1241962 | 8/1960 | France | 175/108 |
| 2420642 | 10/1979 | France . | |
| 12249 | of 1910 | United Kingdom . | |

OTHER PUBLICATIONS

"Cowper's Specification", No. 1612–1871, Jun. 1871.

*Primary Examiner*—James A. Leppink
*Assistant Examiner*—Hoang C. Dang
*Attorney, Agent, or Firm*—Steele, Gould & Fried

[57] ABSTRACT

A method for drilling a hole in a hard material such as rock. According to this method, the rock is fragmented by impact along spaced-apart, parallel paths while it is simultaneous fragmented by shear between these paths. An apparatus for carrying out this method is also disclosed.

9 Claims, 3 Drawing Figures

METHOD AND APPARATUS FOR DRILLING HARD MATERIAL

The present invention relates to a method for drilling a hole in a hard material such as rock, and to an apparatus for carrying out this method.

The conventional method used for drilling a hole in a hard material consists in pulling or pushing a drilling head against the front of hard material to be drilled. The drilling head usually comprises a cylindrical base having substantially the size of the hole to be drilled. The base carries a plurality of grinding rolls or impact hammers on its face to grind away or fragment the hard material. To improve the efficiency of the drilling head, the base is usually rotated about its axis while it is pushed or pulled against the front of hard material.

This conventional drilling method is quite efficient but has the major drawbacks of requiring substantial energy and frequent replacement of the grinding rolls or of the fragmentation heads of the impact hammers.

An object to the present invention is to provide a new method for drilling holes, particularly large holes, in a hard material such as rock, which method is fast, simple and relatively inexpensive to carry out.

Another object of the present invention is to provide an apparatus for carrying out the method according to the invention, which apparatus is relatively simple in construction and fast and efficient in operation.

In accordance with the present invention, it has been found that relatively large holes can be easily drilled in one pass only by simply fragmenting the hard material by impact along a plurality of spaced-apart paths extending in parallel planes. More particularly, it has been found that when each of these paths extend forward to a plane different from the plane in which extend the paths adjacent thereto, the fragmentation carried out by impact causes simultaneous fragmentation by shear of the hard material which is not impacted between the paths.

The tools used for supplying the impact action can be of any type. Use can be made, for example, of standard powered impact hammers, such as pneumatic impact hammers. To obtain the requested fragmentation by shear, at least two of these tools must be employed. Of course, more tools can be used if the hole to be drilled is large in size.

Since at least half of the hard material is removed by shear during the drilling operation, much less power is required to drill the hole than to drill a similar hole by grinding only. Moreover, the hole can be easily drilled in one single pass since all the rock has not to be removed by impact.

Advantageously, fragmentation by impact can be carried out in such a manner that the spaced-apart paths followed by the impact tools are parallel to each other. To do so, the impact tools or hammers can be set in row(s) along a support which is moved reciprocally in translation in a direction perpendicular to the rod.

The present invention therefore proposes a method for drilling a hole in a hard material such as rock, comprising a single step for fragmenting the hard material by impact along a plurality of spaced-apart paths that may be parallel to each other and extend in parallel planes, each of said path extending in a plane different from the planes in which extend the paths adjacent thereto, whereby fragmentation by impact along these paths causes simultaneous fragmentation by shear of the hard material between these paths.

The invention also proposes an apparatus for carrying out the above mentioned method for drilling the front of a hard material such as rock. This apparatus basically comprises:

means for driving a drilling head toward the front of hard material to be drilled; and means for moving the drilling head in a plane parallel to the front of hard material while the drilling head is driven. The apparatus is characterized in that the drilling head comprises a plurality of impact hammers mounted in parallel, spacedapart relationship on a support, each of these hammers projecting from this support towards the front of hard material to be drilled and having a rock-fragmenting head spaced-apart from the support at a distance different from the distance at which the fragmenting heads of the adjacent hammers are located. In other words, the heads are incrementally spaced.

Advantageously, the impact hammers are set in a row along the support of the drill head, and the means for moving the drilling head comprises means connected to the drilling head support for transmitting thereto a reciprocating movement of translation in a direction perpendicular to the row of hammers.

In accordance with a preferred embodiment of the invention, the transmission means comprises a pivoting arm having one end connected to a drilling head support and the other end pivotably mounted about an axis parallel to the row of impact hammers onto the driving means. The transmission means also comprises operating means for rotating the pivoting arm to and fro from one angular position to another about its axis.

Preferably, the pivoting arm may be made of two parallel links having their ends pivotably connected to spaced-apart points on the drilling head support and on the driving means respectively. These links form a parallel linkage with a drilling head support and the driving means, which linkage causes the impact hammers to permanently extend in the same direction towards the front of hard material.

The orientation of the translation movement imparted to the drilling head support by the transmission means is not essential to the invention. As a matter of fact, this orientation can be selected according to the general orientation or the vein of hard material to be drilled.

The invention and its advantages will be better understood in reference to the following non restrictive description of a preferred embodiment thereof, taken in connection with the accompanying drawings in which.

Figure 1:
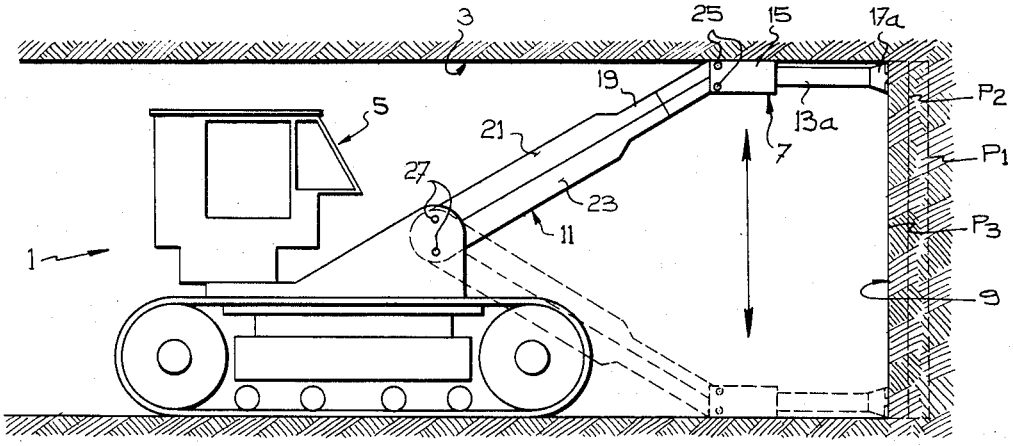
FIG. 1 is a side elevation view of a drilling apparatus according to the invention, in use for drilling an horizontal hole or tunnel.

The drilling apparatus 1 shown in FIG. 1 is particularly well adapted to drill an horizontal hole or tunnel 3. This apparatus 1 comprises means 5 for driving a drilling head 7 towards the front 9 of hard material to be drilled, and means 11 for moving the driving head 7 in a plane parallel to the front of hard material while the drilling head is driven.

The driving means 5 comprises a motorized, powered vehicle which may be, for example, the carrier of a standard excavator.

The drilling head 7 comprises a plurality of impact hammers 13*a* to 13*e* rigidly mounted in spaced-apart relationship onto an horizontal, elongated support 15. The impact hammers 13*a* to 13*e* are set in a row along the support 15 so as to protect therefrom towards the front 9 of hard material to be drilled.

Each hammer 13 has a rock fragmenting head 17 incrementally forward spaced from the support 15 at a distance different from the distances at which the fragmenting heads of the adjacent hammers are located.

All the impact hammers may be of the same standard construction with a cylindrical housing, an impact rod projecting from this housing and an impact head fixed at the free end of the impact rod. Means are provided in the housing of each hammer for moving the impact rod and the head attached thereto in an impacting manner. Means are further provided for rotating the hammer rod and head along their axis. These means that are standard in this industry may be specific to each hammer or may be common to each of them and be included in the support 15 in any conventional manner. While [impact hammers] is the term employed here, any other kind of suitable impacting tool may of course be alternatively used.

Figure 2:
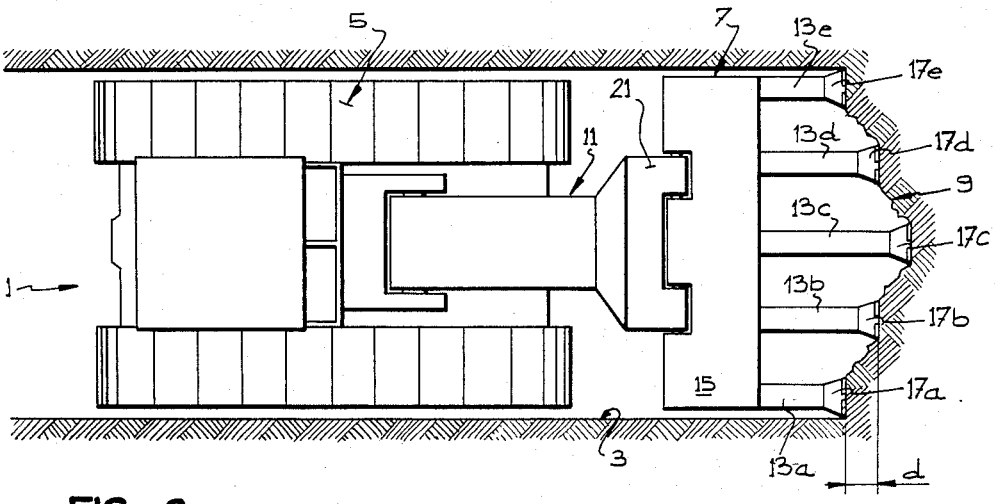
FIG. 2 is a top plan view of the drilling apparatus shown in FIG. 1.

As aforesaid, it is compulsory that the rock fragmenting head 17 of each hammer be incrementally spaced-apart from the support 15 at a distance different from the distances at which the fragmenting heads of the adjacent hammers are located. As shown in FIGS. 1 and 2, the central hammer 13*c* of the rod may be selected to project the farthest from the drill head support 15, while the lengths of the other hammers are selected so that the more they are laterally remote from hammer 13*c*, the shorter they project from the support 15. According to this arrangement, the fragmenting head 17*b* and 17*d* may extend in a same plane $P_2$ which is closer to the support 15 as the plane $P_1$ in which extend the fragmenting head 17*c* of the central hammer 13*c*. Similarly, the fragmenting head 17*a* and 17*e* may extend in a same plane $P_3$ which is closer to support 15 as the plane $P_2$ in which extend the fragmenting heads 17*b* and 17*d*.

The means 11 for moving the drilling head 7 in a plane parallel to the front 9 of hard material while the drilling head is driven by the driving means 5, comprises means connected to the drilling head support 15 for transmitting to this support a reciprocating movement of translation in a direction perpendicular to the row of hammers.

In the embodiment shown in the drawings, the translation movement is carried out up and down. It should be noted however that if the support 15 is orientated in a different manner such as vertically, the moving means 11 will have to move the support 15 laterally in a direction parallel to the ground. It should also be noted that any other orientation, such as an inclined orientation, may be used if desired.

The means for transmitting this reciprocating movement of translation to the drilling head 7 may comprise a pivoting arm 19 made of two parallel links 21 and 23 having their ends pivotably mounted onto spaced-apart axes 25 and 27 extending in the same direction as the row of hammers on the drilling head support 15 and the driving means 5 respectively. The links 21 and 23 of the arm 19 form a parallelogram linkage with the body of the support 15 and the body of the driving means to which they are connected. The purpose of this parallelogram linkage is to cause the impact hammers 13*a* to 13*e* to permanently extend in the same direction towards the front 9 of hard material when the arm 19 is moved to and fro from one angular position to another by any kind of operating means such as a hydraulic cylinder that may be integrated to the driving means 5 or mounted thereto. Since this operative means may be of any kind provided that it moves the arm reciprocally up and down, no further description thereof will be given hereinafter.

In operation, the drilling head 7 is pushed by the driving means 5 towards the front 9 of hard material to be drilled. Simultaneously with this pushing, the drilling head 7 is moved up and down as shown in full and dotted lines in FIG. 1.

Figure 3:
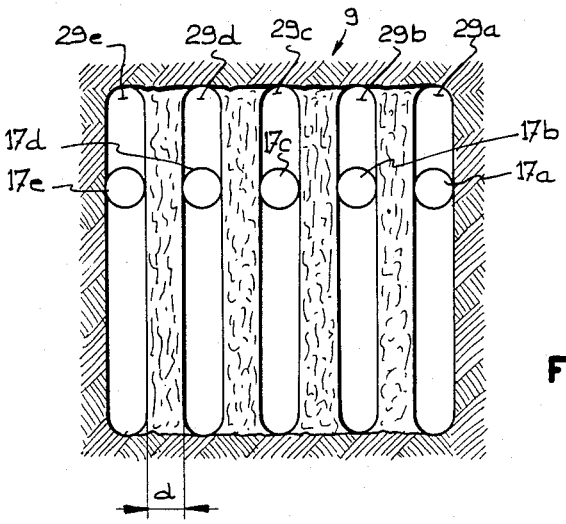
FIG. 3 is a front elevation view of the drilling pattern obtained with the apparatus shown in FIGS. 1 and 2.

The head 17*c* of the central impact hammer 13*c* which projects farther from the housing than the others comes first into contact with the front 9 of hard material and drills or cuts therein a vertical path or step 29*c* as shown in FIG. 3, which path extends in a first plane $P_1$. This path is of course formed by fragmentation of the rock by impact.

As the central hammer 13*c* works its way into the rock, the hammers 17*b* and 17*d* that are immediately adjacent thereto come into contact with the rock as soon as the difference between the distances at which the central hammer 17*c* and the adjacent hammers 17*b* and 17*d* extend, has been achieved. The hammers 17*b* and 17*d* then start also to cut a pair of paths or steps 29*b* and 29*d* which extend in a same plane $P_2$ closer to the support 15 than the plane $P_1$. As shown in FIG. 3, the paths 19*b* and 19*d* are parallel to the path 29*c*. Due to the spaced-apart and offset positions 29*c*, 29*d* and 29*b* of the hammer heads 17*c*, 17*d* and 17*b*, the hard material between the hammers are sheared off naturally to form a roughly sloping surface between the path 29*c* and the paths 29*b* and 29*d* respectively.

As the driving means continues to move forward the drilling head, the lateral hammers 13*a* and 13*e* finally come into contact with the front 9 of hard material and start to cut out two further paths or steps 29*a* and 29*e* parallel to each other but extending in a plane $P_3$ closer to the support 15 than the plane $P_2$. Once again, the hard material between the hammer paths 29*b* and 29*e* and 29*d* and 29*a* respectively, is sheared off naturally to form other roughly sloping surfaces between the paths 29*d* and 29*e* and the paths 29*b* and 29*a*, respectively.

Of course, the rock that is fragmented by the drilled head both by impact and shear falls down past the hammer heads 17 into the tunnel 3 where it can be collected and disposed by any conventional means.

As can be understood, the drilling head 7 acts as a big, powerful rake which is moved up and down against the front 9 of hard material by the driving and moving means 5 and 11.

Advantageously, the spacing distance between each pair of adjacent hammers 13 and therefor between each pair of adjacent paths 29 is selected so as to be identical to the distances between the plane $P_1$, $P_2$ or $P_3$ in which extend these adjacent paths. This particular arrangement has proved to be very satisfactory and efficient.

As can be easily understood, almost half of the surface of the front hard material be drilled in the tunnel 3 is fragmented by shear. Of course, this substantially reduces the energy requirement that would normally be necessary to drill the tunnel using the conventional apparatuses and method.

As can also be understood, the apparatus according to the invention is very simple in structure. Accordingly, it maintenance is very easy to perform.

I claim:

1. A method for impact drilling a hole in a front of hard material such as rock, comprising the steps of:

positioning a plurality of impact tools having rock fragmenting heads parallel to one another in a line;

incrementally spacing adjacent ones of the impact tools such that the impact tools are longitudinally incrementally spaced to extend different distances toward the front;

laterally spacing the impact tools in said line by a distance greater than an area of direct impact of the rock fragmenting heads;

actuating the impact tools as incrementally spaced and reciprocating the impact tools back and forth substantially perpendicular to said line;

advancing the impact tools longitudinally toward the front during said reciprocating, and thereby fragmenting the hard material by striking the front directly with the impact tools along a plurality of spaced-apart paths extending in parallel lines of incrementally different depths in the front of hard material, each of the impact tools fragmenting a path by direct impact with the front across a lateral width along the line with a gap free of direct impact remaining between the impact heads and between adjacent paths followed by the impact heads; and, simultaneously fragmenting material at the gap by shear of said hard material between said paths, due to said incremental spacing.

2. The method of claim 1, wherein the impact tools are positioned at longitudinal spacing substantially equal to their lateral spacing in the line.

3. An improved apparatus for drilling a hole in a front of hard material such as rock, of the type having means for driving a drilling head longitudinally toward the front of hard material to be drilled, and means for moving the drilling head in a plane parallel to said front of hard material while said drilling head is driven, the improvement comprising:

said drilling head comprising a plurality of impact hammers mounted in parallel, spaced-apart relationship on a support and oriented longitudinally toward the front, said hammers having rock fragmenting heads operable to fragment a certain width of rock and being laterally spaced-apart at such a distance from each other that the hard material of the front is directly fragmented across said certain width by direct impact with each of the hammers spaced-apart to define spaced fragmentation paths when the drilling head is driven and moved, and a gap of hard materials between said paths remains free of direct contact with the impact hammers, each of said hammers projecting from said support toward the front of hard material to be drilled at a longitudinal distance incrementally different from the distances at which the fragmenting heads of adjacent hammers project, each of the fragmentation paths extending longitudinally forward toward the front to an incremental distance different from that of paths adjacent thereto, whereby said fragmentation by impact along said paths causes simultaneous fragmentation by shear of said hard material between said paths.

4. The apparatus of claim 3, wherein the impact hammers are set in a row along the support of the drilling head and laterally spaced in said row, and the means for moving said drilling head comprises means connected to the drilling head support for transmitting to said support a reciprocating movement in a direction perpendicular to the row of hammers.

5. The apparatus of claim 4, wherein said transmission means comprises a pivoting arm having one end connected to the drilling head support and the other end pivotably mounted about an axis parallel to the row of impact hammers onto the driving means, and operating means for rotating said pivoting arm to and fro from one angular position to another about said axis.

6. The apparatus of claim 5, wherein said pivoting arm is made of two parallel links having their ends pivotably connected to spaced-apart points on the drilling head support and the driving means respectively, said links forming a parallelogram linkage with said support and said driving means, said linkage causing the impact hammers to permanently extend in the same direction toward the front of hard material.

7. The apparatus of claim 6, wherein said driving means is a motorized vehicle.

8. The apparatus of claim 7, wherein the distance between adjacent impact hammers is substantially identical to the difference of distance existing between the distances at which the fragmenting heads of said adjacent hammers are respectively located from the support.

9. The apparatus of claim 4, wherein adjacent impact hammers are laterally spaced in the row by a distance substantially identical to a longitudinal spacing of the rock fragmenting heads of said adjacent hammers.

* * * * *